United States Patent [19]

Brüngel et al.

[11] Patent Number: 4,881,949

[45] Date of Patent: Nov. 21, 1989

[54] METHOD OF STARTING A GASIFIER

[75] Inventors: Norbert Brüngel, Cologne; Hermann-Josef Schumacher, Bedburg-West, both of Fed. Rep. of Germany

[73] Assignee: Rheinische Braunkohlenwerke AG., Cologne, Fed. Rep. of Germany

[21] Appl. No.: 224,855

[22] Filed: Jul. 27, 1988

[30] Foreign Application Priority Data

Aug. 14, 1987 [DE] Fed. Rep. of Germany ..... 3727146

[51] Int. Cl.[4] ..... C10J 3/54

[52] U.S. Cl. ..... 48/197 R; 48/206; 48/210

[58] Field of Search ..... 48/197 R, 206, 210, 48/DIG. 4; 252/373

[56] References Cited

U.S. PATENT DOCUMENTS

| | | | |
|---|---|---|---|
| 1,981,299 | 11/1934 | Beckler | 219/32 |
| 2,318,195 | 5/1943 | Cate | 175/115 |
| 2,411,040 | 11/1946 | Holthouse, Jr. | 158/28 |
| 2,655,443 | 10/1953 | Moore | 48/DIG. 4 |
| 2,938,577 | 5/1960 | Hughey | 158/123 |
| 3,248,178 | 4/1966 | Hoskinson | 23/277 |
| 3,485,565 | 12/1969 | Kaartinen | 431/3 |
| 4,017,272 | 4/1977 | Anwer et al. | 48/DIG. 4 |
| 4,305,705 | 12/1981 | Velling et al. | 431/208 |
| 4,740,217 | 4/1988 | Lambertz | 48/157 R |

FOREIGN PATENT DOCUMENTS

| | | |
|---|---|---|
| 49803/69 | 8/1970 | Australia . |
| 2306840 | 8/1974 | Fed. Rep. of Germany . |

*Primary Examiner*—Peter Kratz

*Attorney, Agent, or Firm*—Seidel, Gonda, Lavorgna & Monaco

[57] ABSTRACT

For starting a gasifier for the gasification of carbonaceous fuel with an oxygen-bearing gasification agent in a fluidized bed, the gasifier is filled with an inert gaseous medium and put under an increased pressure. After sealing integrity has been established, a combustible gas mixture is ignited in a combustion chamber connected to the lower part of the gasifier, by means of an ignition device which operates under pressure. The gas mixture is thus burnt, while the increased pressure in the gasifier is maintained, at least until the temperature within the gasifier corresponds to the gasification temperature. The arrangement for carrying the method into effect includes a pressure-resistant combustion chamber for combustion of the combustible gas mixture by means of the ignition device. The combustion chamber is connected at least at times to the lower part of the gasifier, by way of an openable slide member. The combustion chamber is arranged at an acute angle relative to the longitudinal axis of the gasifier.

5 Claims, 1 Drawing Sheet

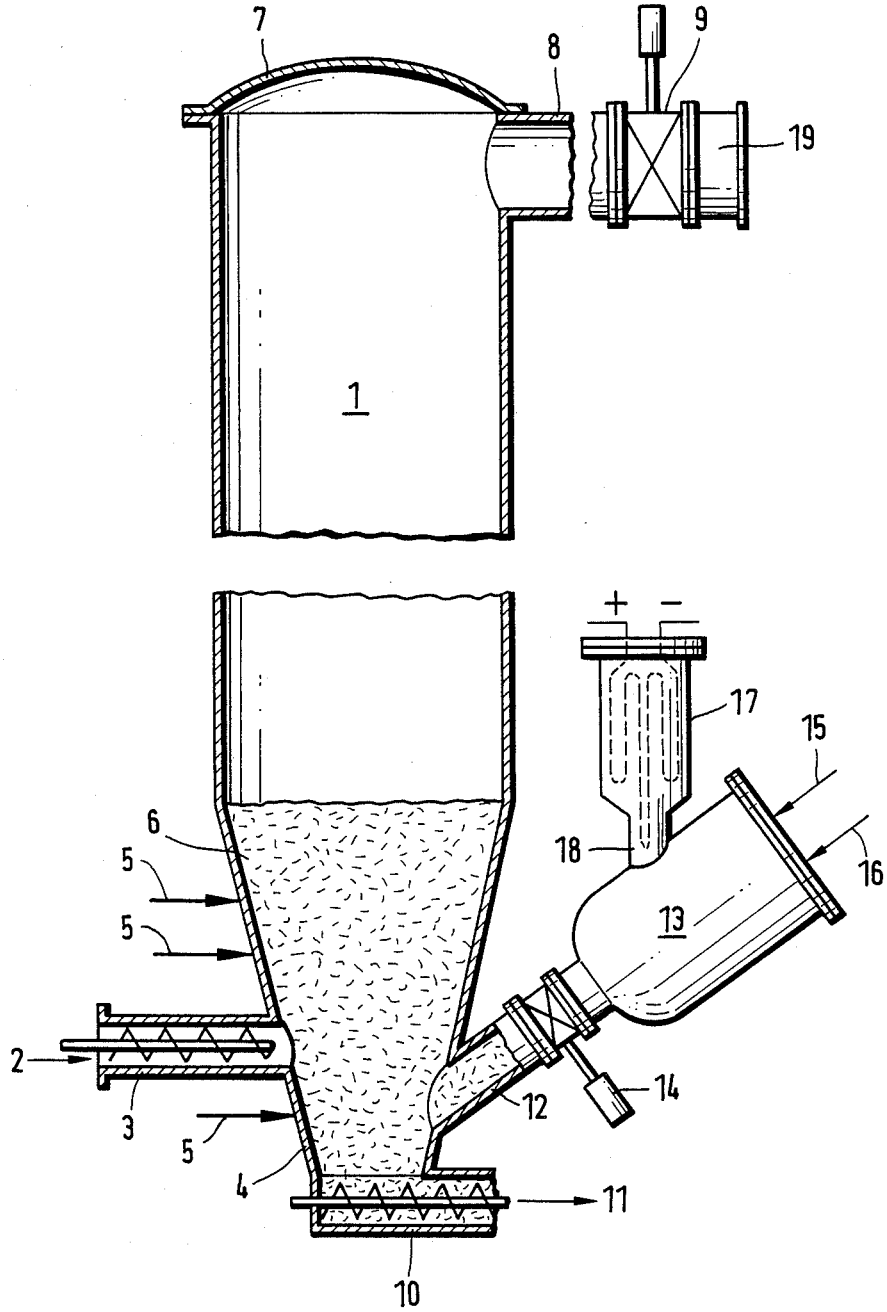
7
8
9
19
1
+
−
17
15
6
5
5
18
16
13
2
3
5
12
14
4
11
10

METHOD OF STARTING A GASIFIER

BACKGROUND OF THE INVENTION

In one form of a method for starting up a gasifier, that is to say heating it up, for conversion of carbonaceous fuel in a fluidised bed, for example in the case of a HTW-gasifier (HTW =High Temperature Winkler), the procedure is such that the gasifier is first filled with an inert gas such as nitrogen, and put under pressure, and checked in respect of gas-tightness. The gas-tightness check is ccarried out using inert gs so that oxygen-bearing gas components which, in spite of the preceding flushing operation using the inert gas, still occur in the gasifier or in the lining thereof, and which could result in undesirable reactions, are removed or are diluted down to a harmless level of concentration.

Following the checking operation, the gasifier is heated up in pressure-less condition to a temperature which at least corresponds to the subsequent gasification temperature, for example between 800 and 1000° C. The heating operation is carried out using as burners which are referred to as heating-up burners. The fact that the heating-up temperature has been reached, in other wordsd the gasifier is ready for regular operation, is detected by measurements taken at the top of the gasifier.

After the conclusion of the starting or heating-up phase, the heating-up burners are disassembled in the hot condition while at the same time all the feed of inert gas is shut down. At the locations at which the heating-up burners were removed, the openings are then closed off with cover members. Because of the possibility of a back flow of hot gases, the operation of removing the burners from the heated-up gasifier can only be carried out with substantial safety precautions being taken.

After the openings of the heat-up gasifier have been closed off with the cover members, the gasifier is flushed again with inert gas in order to drive out any oxygen-bearing gases which may have been able to pass into the gasifier in the operation of removing the burners. That repeated introduction of inert gas is also effected while the gasifier is in a non-pressurised condition, but it is disadvanatageous as in that operation the gasifier inevitably cools down. However the temperataure at which the gasifier still remains, namely about 500 to 600° C., is sufficient to ignite ignition fuel, for example lignite or brown coal coke, which is introduced into the gasifier, and to start off the gasification process, with a progressive feed or oxygen-bearing gasification agent. In that procedure, the amount of oxygen supplied with the gasification agent is only such that sub-stoichiometric reaction of the igniting fuel can occur in order at any event to avoid the presence of unreacted oxygen in the gasifier. The fuel feed is increased and, as that feed increases, the temperature rises until finally the gasifier can be switched over to the regular mode of operation thereof, with a continuous feed of fresh fuel and oxygen-bearing gasification agent.

It will be seen from the foregoing that the above-discussed method of heating up or starting a gasifier is a difficult operation and can only be carried out when using expensive and extensive safety precautions. In addition a considerable amount of the energy introduced is lost again due to the necessary inerting operation faer the initial heating-up process.

SUMMARY OF THE INVENTION

An object of the present invention is to provide a method of starting a gasifier which avoids the disadvantages of the above-discussed method.

Another object of the invention is to provide a method of starting up a gasifier, which is simpler, shorter and more reliable than the previous method and which makes use of the energy supplied for the heating-up operation, without substantial losses for the subsequent gasification process.

Still another object of the present invention is to provide an arrangement for starting a gasifier for the gasification of carbonaceous ofueld, which is of a simple and operationally reliable structure withou involving major structural changes in the transition from the starting operation to regular gasification operation.

In accordance with the present invention, these and other objects are achieved by a method of starting a gasifier for the gasification of carbonaceous fueld by mens of an oxygen-bearing gasification agent in a fluidised bed, wherein the gasifier is filled with an inert gaseous medium and put under an increased pressure. After sealing integrity is established, a combustible gas mixture is ignited by means of an ignition device which is capable of operating under pressure, in a combustion chamber which communicates with the lower part of the gasifier. The combustible gas mixture undergoes combustion substantially while maintaining the increased pressure at least until the temperature with the gasifier at least substantially corresponds to the gasification temperature.

As will be seen hereinafter, the method in accordance with the present invention involves the use of an ignition device which is adapted to operate under pressure, as may be found for example in U.S. Pat. No. 4,305,705 (Velling et al.). The ignition device is thus disposed on a combustion chamber which is provided on the lower part of the gasifier, and it serves to initiate combustion of an ignitable mixture for example of air and fuel gas. As both the ignition of the mixture and also the combustion thereof may take place under pressure, it is possible to initate combustion after the operations of inerting the gasifier and checking it for sealing integrity, without the increased pressure in the gasifier having to be reduced in the meantime. That ensures that the gasifier is ulikely to suffer from fresh leakages which occur after the operation of checking it for se ling integrity, as may occur for example in the previous method which involved the dismantling of components such as the beating-up burners, and/or due to the operation of reducing the pressure in the gasifier in the second inerting operation after the openings which reviously accommodated the burners have been closed off with the cover members.

The hot combustion gases which are thus generated in the combustion chamber are suitable for heating the fuel which is supplied progressively in larger amounts, within the gasifier, in a reducing atmosphere, to the ignition temperature thereof, thereby to initiate final gasification reactions. As that reaction procedure progresses, gasification agent is gradually supplied to the gasifier. In that way the gasifier is brought on line in a comparatively short period of time and with a high degree of operational reliability.

As the gasification procedure progresses, the amount of gas mixture which is burnt in the combustion chamber is reduced. Combustion in the combustion chamber may even be completely shut down. As the ignition flame can be re-lit by way of the ignition device which can be switched on at any time, it is possible to cut in the combustion phase again if the operation of the gasification process shsould be interrupted for a time.

In all, the invention provides a number of advantages, as follows:

the operation of checking the gasifier in respect of sealing integrity and the heating-up and staring process already take place at the desired operating pressure, the combustion chamber including the ignition device is connected to the gasifier, and remains ready for operation at all times, combusstion in the combustion chamber takes place with an excess of combustion gas, combustion in the combustion chamber can be effected both with oxygen and with air, ignition of the combustion process in the combustion chamber can be monitored by means of thermocouple elements, ignition of the combustion process in the combustion chamber is effected by means of a continuously operated ignition device which functions under pressure, the ignition device can be re-started at any time, in the case of multi-line gasification installations, the product gas cn be used as the combustion gas, an individual gasifier within a multi-line gasification installation can always be kept ready for operation and can be brought on line within a very short period of time, that condition being referred to as the stand-by mode of operation, and the gasifier starting times can be shortended.

In another aspect, the above-indicated objects of the present invention are attained by an arrangement for starting a gasifier for the gasification of carbonaceous fuel by means of oxygen-bearing gasification agent, in a fluidised bed, in which a pressure-resistant combustion chamber for combustion of a combustible gas mixture therein is selectively connected at least at times to the lower part of the gasifier. The combustion chamber has an ignition device which is adapted to operate under pressure, for igniting the gas mixture in the combustion chamber. The combustion chamber can be selectively communicated with the gasification space in the gasifier by way of a slide member which is adapted to be opened to provide the communication between the combustion chamber and the lower part of the gasifier.

In an advantageous feature of the invention, the combustion chamber is arranged at an acute angle relative to the longitudinal axis of the gasifier, for that inclined positioning of the combustion chamber facilitates the re-starting process. More specificlly, arranging the combustion chamber in an inclined position ensures that fuel which has passed into the combustion chamber from the fluidised bed in the gasifier and which is intended for gasification in the gasifier can always flow out of the combustion chamber again, under the effect of the force of gravity. If the force of gravity alone is not sufficient to remove the fuel from the combustion chamber in that way, removal of the remaining fuel in the combustion chamber is produced by virtue of the flow of combustion gases which are produced in the combustion chamber.

Further objects, features and advantages of the present invention will be apparent from the following description of a preferred embodiment thereof.

BRIEF DESCRIPTION OF THE DRAWING

The FIGURE is a diagrammatic view in section of a gasifier arrangement.

DESCRIPTION OF THE PREFERRED EMBODIMENT

Referring now to the drawing, illustrated therein is an installation comprising a gasifier 1 which serves for the gasification conversio of carbonaceous fuel as indicated at 2. The fuel 2 is introduced by way of a supply device 3 into the lower part 4 of the gasifier 1, in which it is converted into gas by means of oxygenbearing gsaification agent 5 which is fed to the gasifier 1 by way of a plurality of nozzles (not shown). The reaction of the fuel 2 by means of the gasification agent 5 takes place within a fluidised bed as indiccated at 6. Temperatures of between 800 and 1000° C. and pressures of between 5 and 30 bars obtain within the gasifier 1 in the reaction of the fuel 2.

Reference numeral 7 in the drawing indicates the top of the gasifier 1, while reference numeral 8 indicates the discharge conduit from the gasifier 1. Arranged in the discharge conduit 8 is a slide member 9 for making it possible to adjust the gasification pressure within the gasifier 1.

Disposed at the lower end of the lower part 4 of the gasifier 1 is a discharge arrangement 10 for removing the components 11 of the fuel 2, which cannot be converted into gas.

Connected to a connecting portion 12 which projects upwardly at an acute angle laterally of the lower part 4 of the gasifier 1 is a combustion chamber 13 which is permanently connected to the gasifier 1. However the communication between the interior of the lower part 4 of the gasifier 1 and the interior of the combustion chamber 3 can be selectively opened and closed as desired by means of a slide member 14. The slide member can thus be actuated by suitable means between a position of closing the communication between the combustion chamber 13 and the lower part 4 of the gasifier 1, and another position of opening that communication.

Reference numeral 15 indicates the feed of a combustible gas mixture 15 into the combustion chamber 13. The gas mixture 15 may comprise for example natural gas, producer gas or a mixture of $CO/H_2$. Combustion occurs under pressure by means of oxygen of air, the feed of which is indicated by reference numerral 16. By suitably adjusting the quantitative ratio between the gases 15 and 16, it is possible to ensure that combustion of the combustible gas 15 can only ever be partial, and an excess of oxygen is avoided. Combustion in the combusion chamber 13 in the condition thereof in which it is communicated with the gasifier 1 takes place continuously and that avoids the formation of explosive gas mixtures.

In order to provide for ignition of combustion within the combustion chamber 13, the illustrated installation has an ignition device 17 as described for example in greater detail in U.S. Pat. No. 4,305,705 (Velling et al.) to which reference is herefore suitably made. The ignition device 17 makes it possible for the combustion process in the combustion chamber 13 to be set in operation under pressure, and to be re-started at any time.

The procedure for starting the gasifier 1 for the gasification of the fuel 2 in the fluidised bed is as follows: the gasifier is filled with an inert gaseous medium and put under an increased pressure. After gas-tight sealing integrity has been established, the combustible gas mixture in the combustion chamber 13 which communicates with the lower part 4 of the gasifier is ignited by means of the ignition device 17 which thus operates under pressure. The mixture undrgoes combustion substantially while maintaining the increased pressure at least until the temperature within the gasifier at least substantially corresponds to the gasification temperature. The combustible gas mixture which undergoes combustion in the combustion chamber 13 comprises for example 2000 $m^3/h$ of combustible gas 15 with 200 $m^3/h$ oxygen 16, the ratio between those two components thus being 10:1.

As soon as the gasification temperature in the vicinity of 900° C. is reached within the gasifier 1, the feed of carbonaceous fuel 2 is produced, and oxygen-bearing gasification agent 5 such as air, steam or $O_2$ is introduced in a progressively increasing amount until he gasification procedure is operating. The slide member 14 can then be moved into the position of closing the communication between the combustion chamber 13 and the lower part 4 of the gasifier 1 in order thereby to separate the combustion chamber 13 from the operating chamber in the gasifier 1. Alternatively, with the slide member 14in the open condition, it is possible for an ignition flame as indicated at 18 to be maintained at the ignition device 17 while the supply of combustible gas 15 and oxygen 16 is shut down.

In the procedure for heating up the gasifier 1, the installation basically operates with a gas mixture which is distinguished by a deficiency of oxygen and which therefore is not an explosive mixture. When that fuel gas mixture is burnt, an unburnt excess remains, which is removed at the discharge 8 of the gasifier 1 and passed into a heating gas system or a power generating plant (not shown) where it can undergo complete combustion.

It will be appreciated that the above-described method and arrangement in accordance with the present invention have been set forth solely by way of example and illustration thereof and that various modifications and alterations may be made therein without thereby departing from the spirit and scope of the invention.

What is claimed is:

1. A method of starting a gasifier for the gasification of carbonaceous fuel by means of an oxygen-bearing gasification agent in a fluidised bed comprising filling the gasifier with an inert gas medium and putting it under an increased pressure, establishing gas-tight sealing integrity of the gasifier, and igniting a combustible gas mixture by means of an ignition device which operates under pressure, in a combustion chamber which communicates with the lower part of the gasifier, said mixture undergoing combustion substantially while maintaining the increased pressure at least until the temperature within the gasifier at least substantially corresponds to the gasification temperature.

2. A method as set forth in claim 1 wherein an increasing amount of fuel is fed to the gasifier during combustion of the gas mixture.

3. A method as set forth in claim 2 wherein an increasing amount of gasification agent is fed to the gasifier during combustion of the gas mixture.

4. A method as set forth in claim 1 wherein combustion of the gas mixture in the combustion chamber is cut out during gasification of the fuel in the gasifier.

5. A method as set forth in claim 1 wherein combustion of the gas mixture in the combustion chamber is restricted to burning an ignition flame at the ignition device.

* * * * *